US007603064B2

(12) United States Patent
Ishida

(10) Patent No.: US 7,603,064 B2
(45) Date of Patent: Oct. 13, 2009

(54) UNIT FOR TONE-PROCESSING IMAGE DATA USING SCREEN PATTERN WITH DIFFERENT SCREEN ANGLES FOR TONERS OF SAME HUE AND DIFFERENT DENSITY

(75) Inventor: Tomohito Ishida, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 299 days.

(21) Appl. No.: 11/572,978

(22) PCT Filed: Sep. 5, 2005

(86) PCT No.: PCT/JP2005/016675

§ 371 (c)(1),
(2), (4) Date: Jan. 30, 2007

(87) PCT Pub. No.: WO2006/028230

PCT Pub. Date: Mar. 16, 2006

(65) Prior Publication Data

US 2007/0264050 A1 Nov. 15, 2007

(30) Foreign Application Priority Data

Sep. 7, 2004 (JP) ..... 2004-259755

(51) Int. Cl.
*G03G 15/00* (2006.01)

(52) U.S. Cl. ..... 399/223

(58) Field of Classification Search ..... 399/27, 399/51, 223, 298, 231
See application file for complete search history.

(56) References Cited

U.S. PATENT DOCUMENTS 4,108,654 A 8/1978 Goren et al. ..... 430/43

(Continued)

FOREIGN PATENT DOCUMENTS

EP 1 376 255 A2 1/2004

(Continued)

OTHER PUBLICATIONS

Translation of an Official Action dated May 9, 2008 in CN 2005800300749.

(Continued)

*Primary Examiner*—Quana M Grainger
(74) *Attorney, Agent, or Firm*—Fitzpatrick, Cella, Harper & Scinto

(57) ABSTRACT

The electrophotographic image recording apparatus includes a photoconductive image bearing member, a charging unit, an exposure unit, developing means, a transferring unit suited to superimpose and transfer the plural kinds of toner images obtained by the developing means, and a processing unit adapted to execute halftone processing image data to be sent to the exposure unit, wherein the plural kinds of toners include two kinds of toners of the same hue and differing in density from each other, and the processing unit tone-processes by the use of a screen pattern having different screen angles for the respective toners. In an electrophotographic image recording apparatus for forming an image by the use of a plurality of colorants including two kinds of colorants of substantially the same hue and differing in density from each other, and an image processing apparatus, a higher quality of image is achieved. Tone processing is effected by the use of a screen pattern having different screen angles for the respective toners.

5 Claims, 10 Drawing Sheets

U.S. PATENT DOCUMENTS

| | | | | |
|---|---|---|---|---|
| 5,644,403 | A * | 7/1997 | Watanabe | 358/296 |
| 6,327,450 | B1 | 12/2001 | Ito | 399/227 |
| 6,498,910 | B2 | 12/2002 | Haneda | 399/51 |
| 6,996,358 | B2 | 2/2006 | Ayaki et al. | 399/223 |
| 2004/0013958 | A1 | 1/2004 | Ayaki et al. | 399/223 |
| 2005/0019681 | A1 | 1/2005 | Ito | 430/45 |

FOREIGN PATENT DOCUMENTS

| | | |
|---|---|---|
| EP | 1 500 989 A1 | 1/2005 |
| JP | 5-035038 | 2/1993 |
| JP | 8-171252 | 7/1996 |
| JP | 2000-231279 | 8/2000 |
| JP | 2000-305339 | 11/2000 |
| JP | 2000-347476 | 12/2000 |
| JP | 2001-290319 | 10/2001 |

OTHER PUBLICATIONS

Translation of the abstract of the Korean Patent application laid-open No. 2000-31620.

* cited by examiner

UNIT FOR TONE-PROCESSING IMAGE DATA USING SCREEN PATTERN WITH DIFFERENT SCREEN ANGLES FOR TONERS OF SAME HUE AND DIFFERENT DENSITY

TECHNICAL FIELD

This invention relates to an electrophotographic image recording apparatus for use, for example, in a copying machine, a printer, a facsimile apparatus, a plate making system or the like, and an image processing apparatus therefor.

BACKGROUND ART

As high-speed image forming apparatuses high in quality of image, there are known copying machines and laser beam printers adopting an electrophotographic process. With the advance of digital technology in recent years, the requirement for the higher quality of image of the electrophotographic image recording apparatus is rising in the POD market to the consumer's market such as offices and homes, and the requirement for an image subjected to screen processing such as printing, as well as an image characteristic like a silver salt photograph which is very high in gradation and has a wide color reproducing range and good graininess has further been rising.

This electrophotographic image recording apparatus is such that light is applied to an image bearing member by light, e.g. a laser beam or the like, and an image is recorded by the amount of light applied at that time, and can form all images from a binary image such as a character to an image such as a photograph including a halftone. When reproducing the medium density at this time, use is made of a pulse width modulating process (PWM process) and an image processing technique such as a dither method or a density pattern method, whereby various patterns can be formed on the image bearing member.

Charged toner particles are made to adhere to the obtained pattern on the image bearing member, and are further transferred onto and fixed on paper to thereby obtain a final output image. As the toner particles used at this time, toner particles of four colors, i.e., cyan, magenta, yellow and black, are popular, and various improvements have been applied thereto in order to improve various image characteristics such as graininess, gradation, density, chroma and gloss.

Also, with a view to further enhance the quality of image, in Japanese Patent Application Laid-open No. H5-35038, Japanese Patent Application Laid-open No. H8-171252, Japanese Patent Application Laid-open No. 2000-231279, Japanese Patent Application Laid-open No. 2000-305339, Japanese Patent Application Laid-open No. 2000-347476 and Japanese Patent Application Laid-open No. 2001-290319, there is disclosed a technique of using a plurality of toners differing in density level from one another to realize further improvements in graininess and gradation reproducibility in a high light to halftone area.

In hard copies such as printed matters, a screen angle is provided in a dither pattern used for the outputting of each color to thereby keep the uniformity of the color relative to the positional deviation of each color, and suppress the occurrence of moiré. Particularly, the occurrence of moiré is greatly affected by the combination of the screen angles of the respective colors, and as the combination widely spread in printing apparatuses, etc., mention may be made of yellow 0°, cyan (or magenta) 15°, black 45° and magenta (or cyan) 75°.

In an electrophotographic image recording apparatus provided with developing apparatuses capable of developing with two or more kinds of dark color and light color toners differing in density from each other, it is often practiced to use dither patterns of the same screen angle for the toner kinds of substantially the same hue, e.g. dark cyan and light cyan, and set the screen angles of cyan (light cyan), magenta (light magenta), yellow and black, as described above.

If dither patterns of the same screen angle are used for toner kinds of substantially the same hue, e.g. dark cyan and light cyan, when the positional deviation thereof has occurred in a surface, the unevenness of density, strictly, the unevenness of color will occur. When for example, a belt transfer member made of resin is used as an intermediate transferring apparatus, positional deviation of the order of several μm to 150 μm occurs in an image transporting direction.

When a screen of 200 lines has been formed, the screen structure is repeated at a cycle of the order of 120 μm, and when the above-mentioned positional deviation of the order of 100 μm to 150 μm has occurred, the phase of the screen structure is just reversed and thus, locations juxtaposed and locations overlapping each other appear repetitively, and great density unevenness occurs.

In such a case, it is also practised to effect direct transfer from the image bearing member to a final supporting member, or adopt a cylindrical intermediate transferring drum of relatively high rigidity as the intermediate transferring apparatus, thereby avoiding the above-noted evil, but this has not led to a drastic solution.

Also, to combine screens having five or more kinds of different angles to thereby form an image, the degree of freedom of the setting of the screen angles is low, and a Rosetta pattern occurring when screens of different angles are combined occurs at a low frequency and becomes noticeable. It is preferable to dispose toner kinds of the same hue and differing in density, e.g. cyan and light cyan, or magenta and light magenta, adjacent to each other, and uniformly dispose cyan, magenta, yellow and black used in a conventional process, as has heretofore been done.

Also, as dither patterns used for toner kinds of the same hue and differing in density, it is more preferable to use dither patterns approximate to each other in the angle with respect to the image transporting direction. In a popular electrophotographic image recording apparatus, the deviation of the printing position often occurs in the image transporting direction, and the screen angle most difficult to be affected by the deviation of the printing position is in the same direction as the image transporting direction, and this owes to the fact that the influence of the positional deviation is smaller in the order of the angles nearer to the image transporting direction.

It is also possible to dispose dither patterns used for the toner kinds of the same hue and differing in density adjacent to each other, and dispose dither patterns lower in density, e.g. light cyan and light magenta adjacent to each other. By adopting such a construction, the screen angles of cyan, magenta, yellow and black which are the basic hues of subtractive color mixture are ideally disposed and the screens of the toner species difficult to notice to each other, whereby it becomes possible to minimize the influence of the Rosetta pattern and positional deviation upon color unevenness.

DISCLOSURE OF THE INVENTION

The present invention has been made in view of the above-noted points and an object thereof is to provide an electrophotographic image recording apparatus which realizes an image output of high definition in a DP-system.

Another object of the present invention is to apply discrete dither patterns to respective toner species when image outputting is effected by the use of two or more kinds of toners differing in density from each other, thereby uniform color reproduction even if positional deviation occurs.

Still another object of the present invention is to provide an electrophotographic image recording apparatus provided with a photoconductive image bearing member, charging means for uniformly charging the image bearing member, exposure means for image-exposing the surface of the image bearing member after charged to thereby form an electrostatic latent image, developing means for causing a toner to adhere to the electrostatic latent image to thereby form a toner image, and transferring means for transferring the obtained toner image to a final supporting member such as plain paper, wherein provision is made of developing apparatuses capable of developing with two or more kinds of dark color and light color toners differing in density from each other, and discrete dither patterns are applied to the respective toner species.

Yet still another object of the present invention is to provide an image processing apparatus for an image forming apparatus for forming a color image by the use of plural kinds of colorants, having a processing unit adapted to execute halftone processing image data to be sent to the image forming apparatus, wherein the plural kinds of colorants include two kinds of colorants of substantially the same hue and differing in density from each other, and the processing unit tone-processes by the use of screen patterns having screen angles differing for the respective colorants from each other.

Other objects, constructions and effects of the present invention will become apparent from the following detailed description and the accompanying drawings.

BEST MODE FOR CARRYING OUT THE INVENTION

A binarizing technique in the present invention will first be described.

Figure 8A:
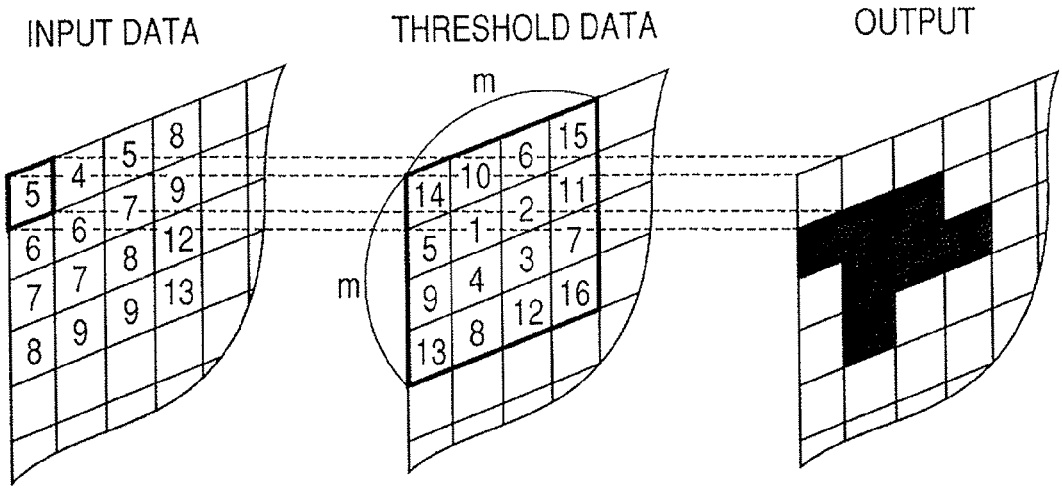
FIGS. 8A, 8B and 8C illustrate the image forming technique of the present invention.
Figure 8B:
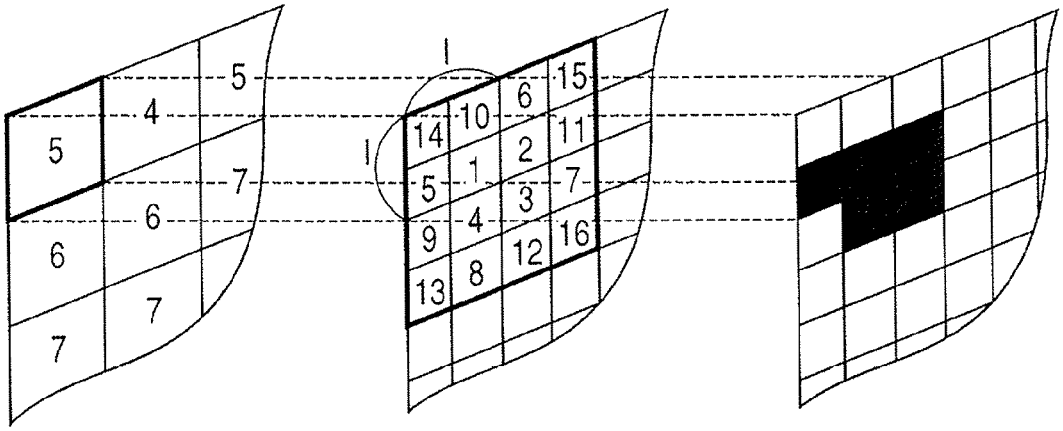
Figure 8C:
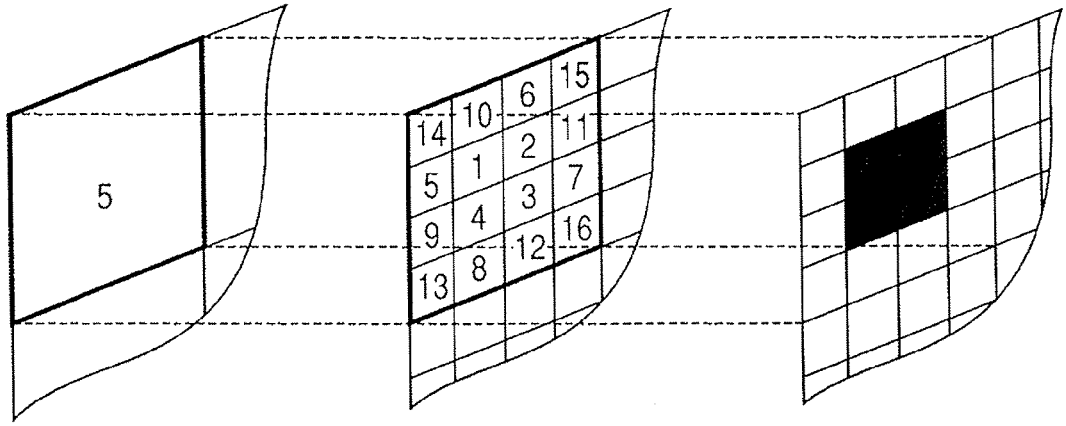

Numerous methods have been proposed as binarizing or quantiging techniques for halftone reproduction. The usually most frequently used methods are the dither method and the dot pattern method. The dither method, as shown in FIG. 8A, a pixel of a read input signal is made to correspond to a pixel of binary recording. The dot pattern method, as shown in FIG. 8C, a pixel of a read input signal is made to correspond to a plurality of recording pixels. As a technique positioned between these two, as shown in FIG. 8B, there is a method of making a pixel of a read input signal correspond to a partial matrix (l×l) in a matrix of m×m. In this correspondence to the partial pixel, l=1 corresponds to the dither method, and l=m corresponds to the dot pattern method, and by assuming any value, the output image size can be changed.

The dither pattern used as the technique of binarizing or quantizing the halftone reproduction as described above is divided broadly into a screen pattern having screen structure, and an error diffusing method having not the screen structure.

Description will hereinafter be made of the dither pattern having screen structure (called the screen pattern).

Figure 9:
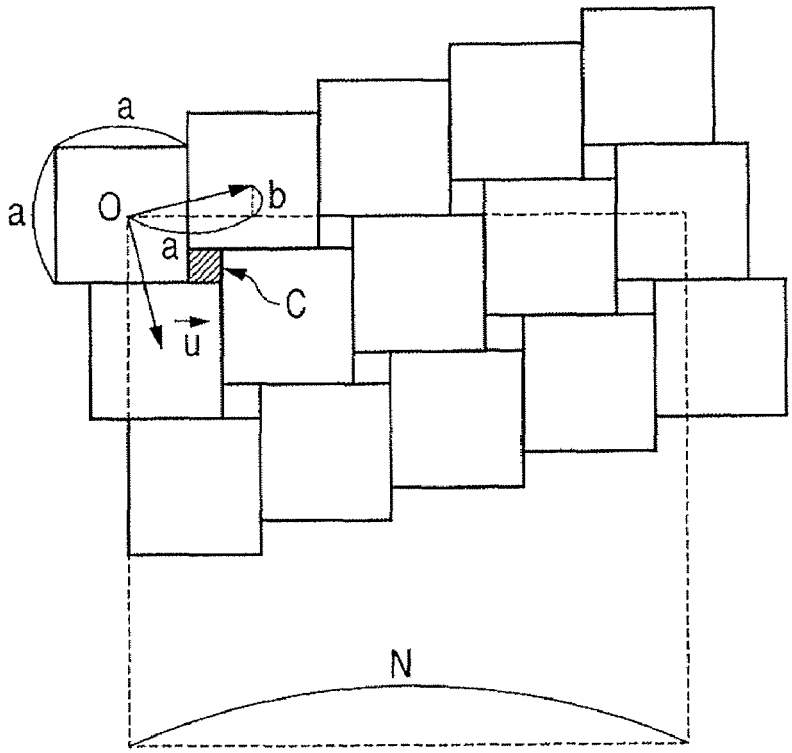
FIG. 9 illustrates the image forming technique of the present invention.

A basic dot (basic cell) comprising a×a pixels is suitably deviated and disposed in the dither pattern of each color, as shown in FIG. 9, whereby a dot having a screen angle can be made. Assuming that the value by which the basic dot is deviated (displacement vector) is u=(a, b), the obtained screen angle θ can be found from;

$$\theta=\tan^{-1}(b/a).$$

When the value of such displacement vector u is calculated by the use of a and b, a tetragonal threshold value matrix size N corresponding to a cycle of the dot becomes $$N=LCM(a,b)\times(b/a+a/b),$$

where LCM(a, b) represents the minimum common multiple of a and b.

As the effects of providing different screen angles in the respective colors, mention may be made of the uniformity of the colors being capable of being kept even when the positions of the respective colors deviate, and further, the occurrence of moiré being suppressed. Particularly the occurrence of moiré is greatly affected by the combination of the screen angles of the respective colors, and the combination widely spread in printing apparatuses or the like is set to yellow 0°, cyan (or magenta) 15°, black 45° and magenta (or cyan) 75°, etc. In an electrophotographic image recording apparatus, the adjustment of the screen angle is effected within the limit range of resolution such as 600 dpi, 1200 dpi or 2400 dpi.

It is also possible to use a technique of providing a phase difference in the above-described pulse width modulating process (PWM process), and providing a screen angle.

Also, the dither pattern forming technique used in the present embodiment can output multiple values, and the value of an input pixel and the threshold value of each dither matrix pattern can be compared with each other, and the gradation of the matrix pattern when the former value exceeds the latter threshold value can be outputted. The turn-on width of a laser pulse at this time is controlled by the gradation, but the turn-on position at that time can be set to "the center the left or the right" with the influence of the pixel position in the matrix pattern or the influence of the surrounding pixels taken into account.

Figure 10:
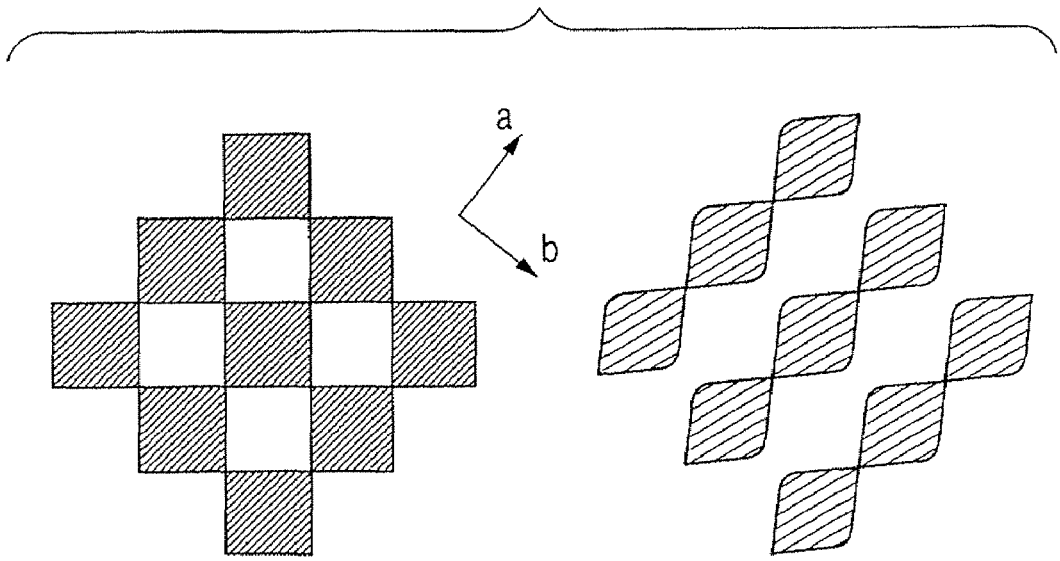
FIG. 10 illustrates the image forming technique of the present invention.

FIG. 10 schematically shows a dither pattern obtained by the binarizing technique in the present invention. The dither pattern shown in FIG. 10 is a pattern used chiefly in printing apparatuses, but in the present invention as well, the above-mentioned technique is used to make a pattern shape conforming thereto.

Figure 1:
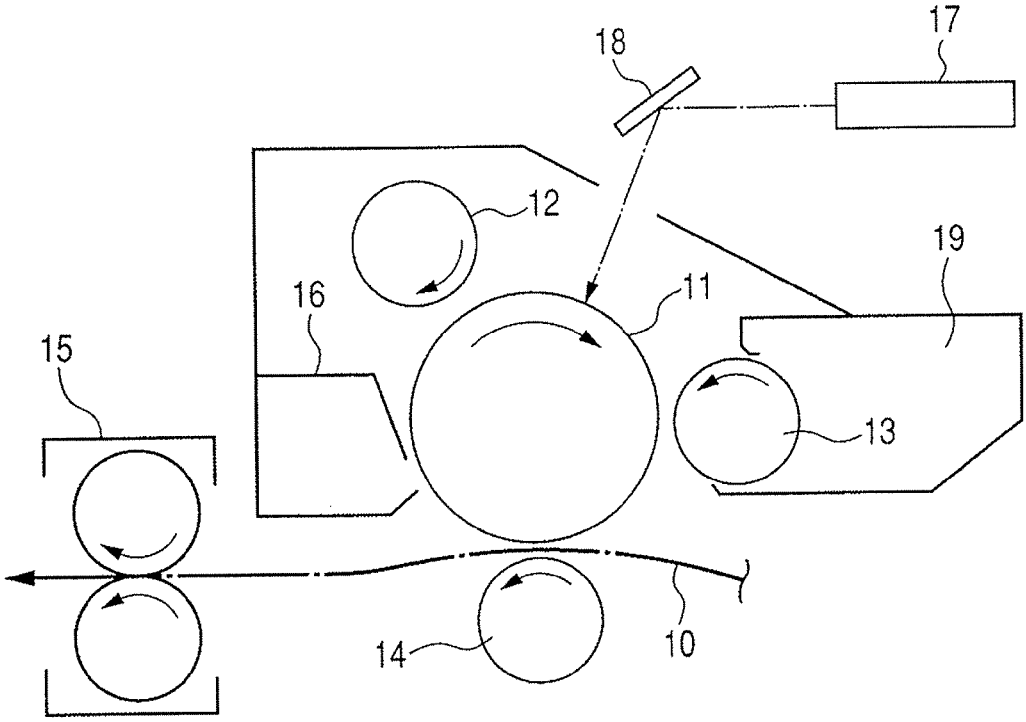
FIG. 1 shows the construction of a color image forming apparatus according to the present invention.

FIG. 1 is a schematic view showing an image forming apparatus according to the present embodiment. This apparatus is an electrophotographic recording apparatus comprising a photosensitive drum 11 and a charger 12, an image exposure device 17, a developing device 19 and a transferring charger 14 disposed around the photosensitive drum 11, a fixing device 15 and a cleaning member 16.

The photosensitive drum 11 as an image bearing member may be of a function separate type comprising two layers like a charge generating layer and a charge transporting layer with an electrically conductive supporting base as the lowermost layer, or a single layer type. The usable film thickness is the order of 5-30 μm, and a construction having a surface layer for improving durability, the cleaning property and the charging property is also of course possible.

As the charging means, mention may be made of a corona charging type using a corona charger comprising a wire and an electric field control grid, or a roller charging type which applies a DC bias or a superimposed bias comprising a DC bias and an AC bias to a charging roller brought into contact with the image bearing member to thereby charge.

As the image exposure device 17 as exposure means, use can be made of a scanner type one using a semiconductor laser, or one which effects image exposure on an LED through a SELFOC lens which is a light condensing device, or other optical system such as an EL element or a plasma light emitting element.

It is also possible to use a short wavelength laser (a so-called blue laser violet laser) having a light source wavelength in the vicinity of 400 nm-420 nm which has been attracting attention in recent years, and by using a blue laser optical system realizing a minute spot shape, not only the stability of a high light portion is increased, but also the stability of a gradation area into which a dark color toner begins to enter is markedly improved and therefore, a pseudo outline caused by the changeover of light and shade, and the aggravation of graininess caused by a dark color toner beginning to enter can be suppressed.

Also, by using such blue laser optical system together with a photosensitive member having a film thickness of 20 μm or less, it is possible to form a latent image profile of higher definition. At this time, it is more preferable to coat a surface layer with a protective layer of high hardness to thereby prevent the lowering of durability caused by the film thickness being made smaller.

Further, as a developing method, use can be made of one of various developing methods such as a magnetic one-component non-contact developing method of carrying a magnetic toner by a magnetic force, and causing the toner to fly onto an image bearing member in non-contact at a developing nip to thereby develop, a magnetic contact developing method of causing the magnetic toner to contact with the image bearing member at the developing nip to thereby carry out a developing process, a nonmagnetic one-component non-contact developing method of regulating and charging a nonmagnetic toner by a blade, carrying the toner on a developing sleeve and causing the toner to fly in non-contact at the developing nip to thereby develop, a nonmagnetic one-component contact developing method of causing the nonmagnetic toner to contact with the image bearing member to thereby carry out the developing process, and a two-component developing method of mixing the nonmagnetic toner with a carrier which is a magnetic powder material, and carrying the mixture to the developing nip by the developing sleeve to thereby carry out the developing process.

As a transferring method, use can be made of a transferring method utilizing an electrical force or a mechanical force. As the method of effecting transfer by the utilization of the electrical force, mention may be made of a corona transferring method of applying a DC bias of a polarity opposite to the charging polarity of a toner by a corona wire to thereby effect transfer, or a roller transferring method of bringing a roller into contact with a image bearing member, and applying a bias of a polarity opposite to the polarity of the toner.

Description will now be made of the modes of the toner in the present invention.

As a cyan colorant usable in a light color cyan toner and a dark color cyan toner, mention may be made of a copper phthalocyanine compound or a derivative thereof, an anthraquinon compound, a base dye lake compound or the like. Specifically, C.I. pigment blue 1, 7, 15, 15:1, 15:2, 15:3, 15:4, 60, 62 or 66 can be particularly suitably utilized. These colorants and a yellow colorant, a magenta colorant or the like which will be described later may be mixed together to thereby provide a cyan toner having preferable suitable values of a*, b* and L*. These colorants can be used singly or together, or in the state of a solid solution.

The colorants of cyan, magenta and yellow toners will now be described.

As a black colorant, mention may be made of carbon black, a magnetic material or a colorant toned into black by the use of yellow/magenta/cyan colorants shown below.

As the yellow colorants, mention may be made of compounds represented by a condensation azo compound, an isoindolinon compound, an anthraquinone compound, an azo metal complex, a methine compound and an allylamide compound. Specifically, C.I. pigment yellow 12, 13, 14, 15, 17, 62, 74, 83, 93, 94, 95, 97, 109, 110, 111, 120, 127, 128, 129, 147, 168, 174, 176, 180, 181 or 191 is suitably used.

As the magenta colorant, mention may be made of a condensation azo compound, a diketopyrrolo-pyrrole compound, anthraquinone, a quinacridone compound, a base dye lake compound, a naphthol compound, a benzimidazolon compound, a thioindigo compound, or a perylene compound. Specifically, C.I. pigment red 2, 3, 5, 6, 7, 23, 48:2, 48:3, 48:4, 57:1, 81:1, 144, 146, 166, 169, 177, 184, 185, 202, 206, 220, 221 or 254 is particularly preferable.

As the cyan colorant, mention may be made of a copper phthalocyanine compound or a derivative thereof, an anchraquinone compound, a base dye lake compound or the like. Specifically, C.I. pigment blue 1, 7, 15, 15:1, 15:2, 15:3, 15:4, 60, 62 or 66 can be utilized particularly suitably.

As the magnetic material, there is a metal oxide containing an element such as iron, cobalt, nickel, copper, magnesium, manganese, aluminum or silicon. Above all, a material having as a chief component iron oxide such as triiron tetroxide or r-iron oxide is preferable. From the viewpoint of the control of the chargeability of the toner, a metal element such as silicon element or aluminum element may be contained. As regards these magnetic particles, the BET ratio surface area by the nitrogen adsorption method should preferably be 2-30 m2/g, and particularly preferably be 3-28 m2/g, and a magnetic material having Moh's hardness of 5-7 is preferable.

Description will now be made of the mode of the developing apparatus in the present invention.

Figure 5:
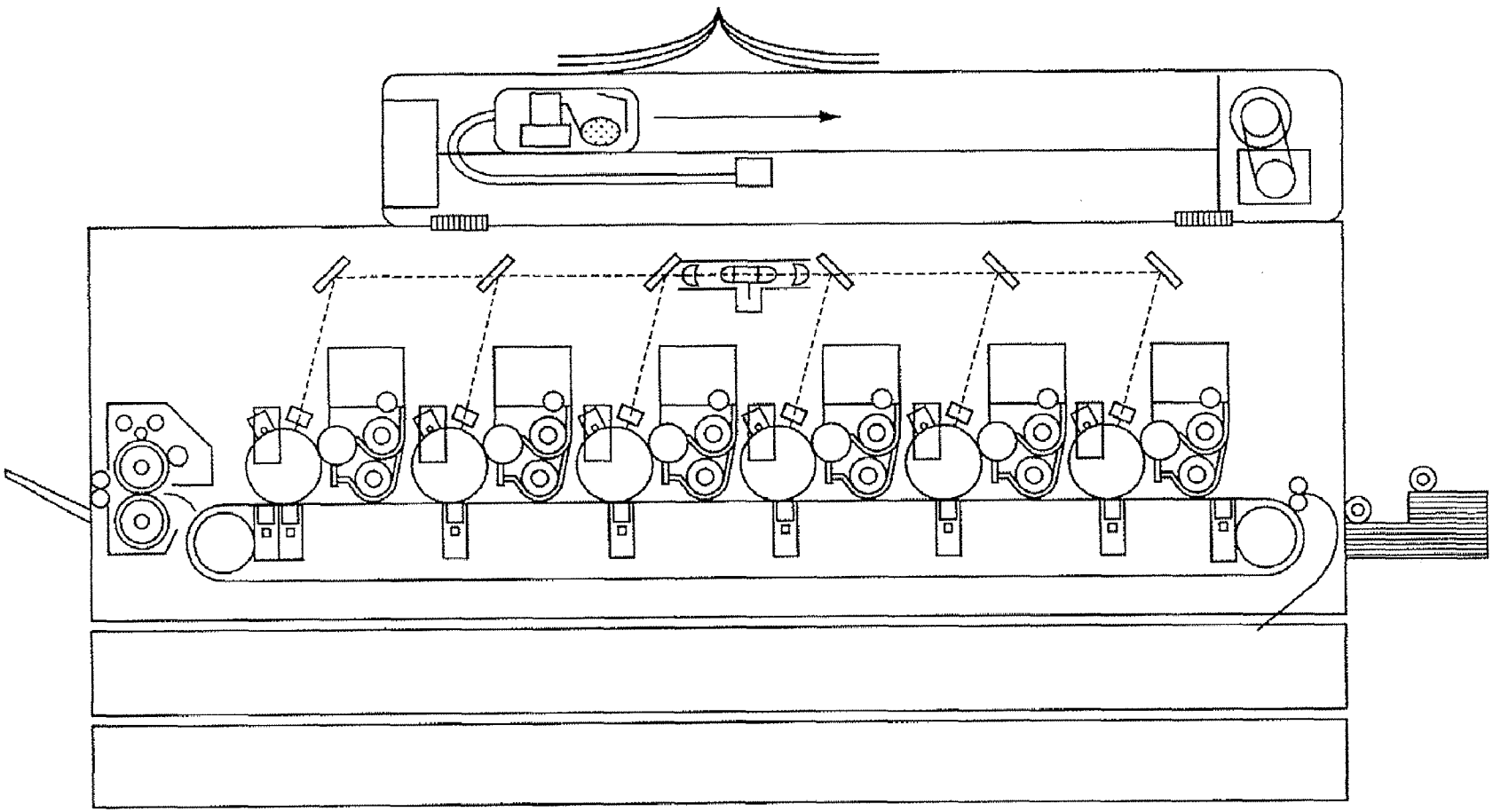
FIG. 5 illustrates the system construction of the present invention.
Figure 6:
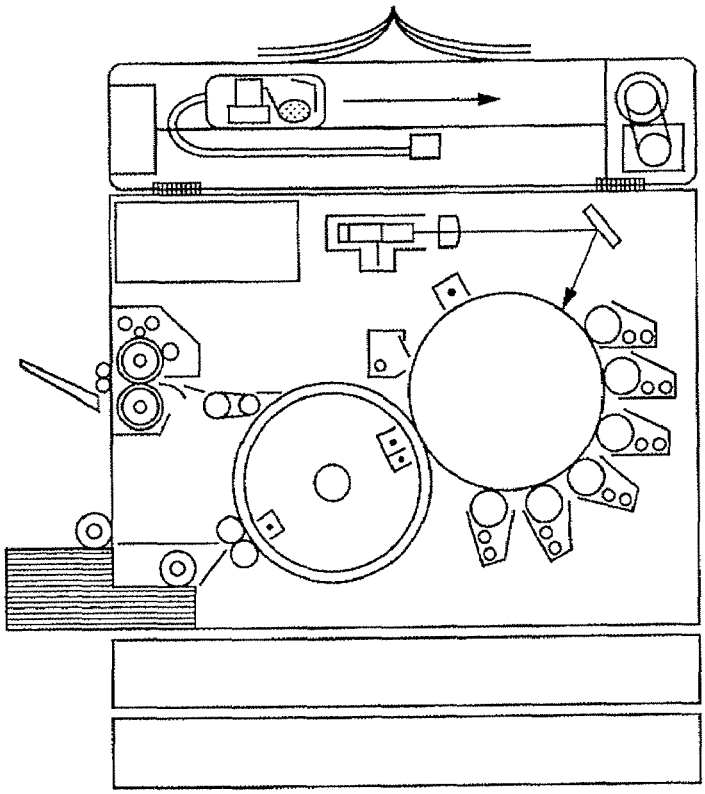
FIG. 6 illustrates the system construction of the present invention.

The developing apparatus in the present invention, as shown in FIGS. 5 and 6, can be provided with two or more kinds developing apparatuses having two or more stations, and differing in density level from each other, and permits various combinations. Typical combinations as the then combinations of the toner kinds are shown below by the use of the following symbols.

1. Cyan, Light Cyan, Magenta, Yellow, Black (5 colors in total)
2. Cyan, Light Cyan, Magenta, Light Magenta, Yellow, Black (6 colors in total)
3. Cyan, Light Cyan, Magenta, Light Magenta, Yellow, Dark Yellow, Black (7 colors in total)
4. Cyan, Light Cyan, Magenta, Light Magenta, Yellow, Dark Yellow, Black, Light Black (8 colors in total)
5. Light Blue, Cyan, Light Red, Magenta, Light Green, Dark Yellow, Black (7 colors in total)
6. Light Cyan, Blue, Light Magenta, Red, Yellow, Green, Black (7 colors in total)
7. Black, Light Black (2 colors in total) etc.

As described above, various combinations are conceived, and besides these, any combination can be used. Also, as the toner kinds, use can of course be made of special color toners such as green, red, blue, orange and white toners, and a colorless toner containing no colorant to improve the sense of gloss.

Description will now be made of the image forming operation of the above-described image forming apparatus.

As regards image forming means used in the present embodiment, when inputting is effected in RGB and outputting is effected in six colors, i.e., cyan, light cyan, magenta, light magenta, yellow and black, input data such as SRGB is resolved into respective colors to be used in the device.

Figure 12:
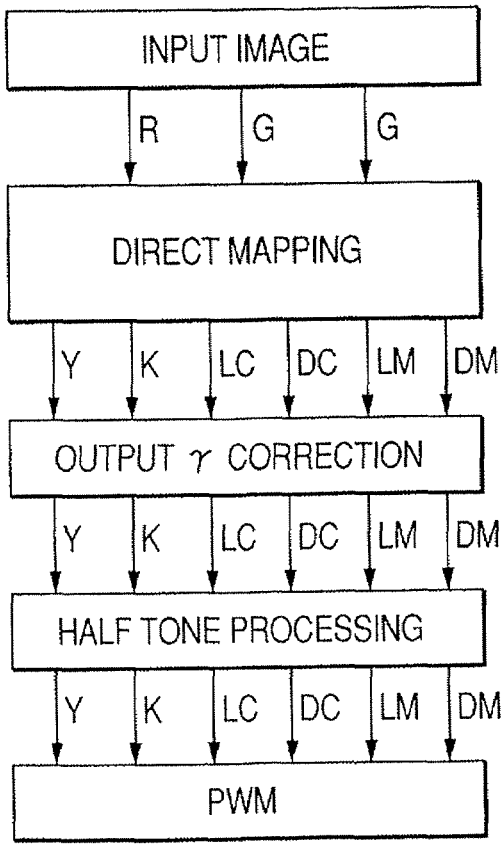
FIG. 12 illustrates the system construction of the present invention.

When this color resolution is to be effected, it is desirable that the image processing apparatus effect direct mapping as shown in FIG. 12. Further, image data is subjected to output γ correction, halftone processing and PWM, and thereafter is inputted to the aforedescribed image exposure device 17. The image exposure device 17 effects exposure conforming to the inputted image data to thereby form an electrostatic latent image.

Also, the image converting process at this time is carried out with a host computer in charge of data transmission and the electrophotographic apparatus connected together, but for each image converting process, a technique most efficient in both of speed and cost is adopted, depending on the information processing capability of the controller of the electrophotographic apparatus and the host computer.

Figure 2:
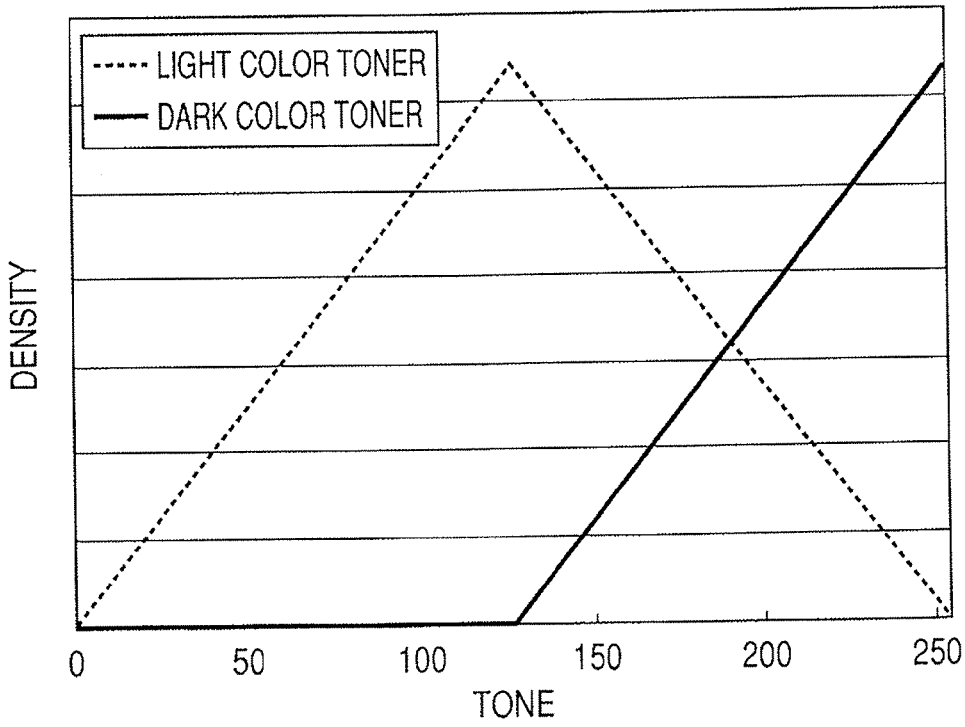
FIG. 2 illustrates the image forming technique of the present invention.
Figure 11:
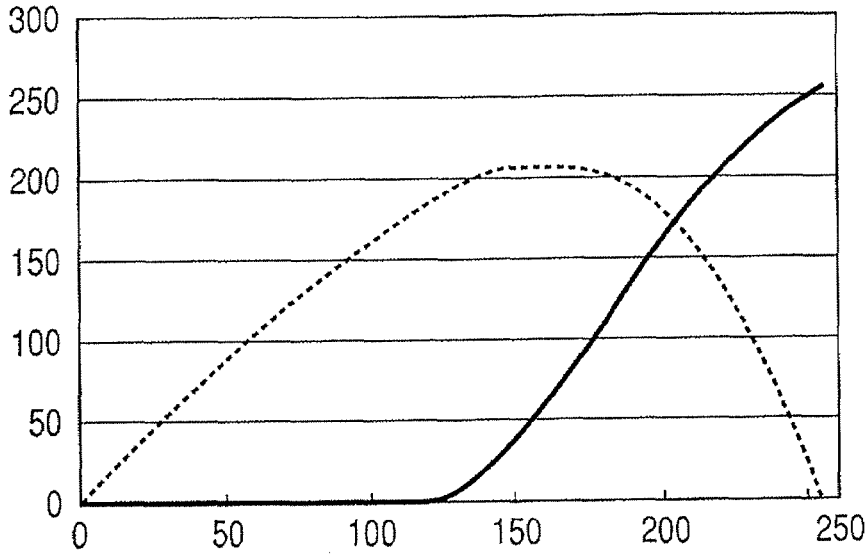
FIG. 11 illustrates the image forming technique of the present invention.

Regarding the conversion of light and shade into edition data, various combinations are conceivable depending on the density levels of the toners, and FIG. 2 shows a basic linear tone. As shown, a light color toner rises earlier at high light, and a dark color toner begins to enter from the vicinity of halftone, and the use of the light color toner is limited in a high density portion while the toner is reproduced by the combination of light and shade for a while. The combination of light and shade at this time is determined by the relation between the quality of image such as graininess, gradation and color gamut and the amount of toner consumption. Also, while a linear tone is shown for simplicity in FIG. 2, actually it is preferable that as shown in FIG. 11, a gentle curve be described at the beginning of entering of the density of each of deep and light color toners.

In the present embodiment, two or more kinds of toner species differing in density level are prepared depending on the difference in the content of the same colorant, with respect to two sets, i.e., the cyan origin of cyan and light cyan, and the magenta origin of magenta and light magenta, and a system is constituted by six colors, i.e., cyan, light cyan, magenta, light magenta, yellow and black.

Light and dark cyan and magenta toners were prepared by the use of the following low materials.

Cyan: polyester resin (100 parts by weight)/phthalocyanine pigment (3 parts by weight), light cyan: polyester resin (100 parts by weight), light cyan: polyester resin (100 parts by weight)/phthalocyanine pigment (0.6 part by weight, magenta: polyester resin (100 parts by weight)/quinacridone pigment (3 parts by weight), light magenta: polyester resin (100 parts by weight)/quinacridone pigment (0.6 part by weight).

The above-mentioned raw materials were preliminarily mixed together by a Henschel mixer, were melted and kneaded by a two-axis extrusion type kneading machine, and were cooled, and thereafter were roughly crushed to the order of 1-1 mm by the use of a hammer mill. Then, they were finely crushed by an air jet type pulverizer. The obtained finely crushed materials were classified, and silica was extraneously added thereto to thereby obtain cyan, light cyan, magenta and light magenta particles having a weight mean particle diameter of 5.6 μm.

Figure 3:
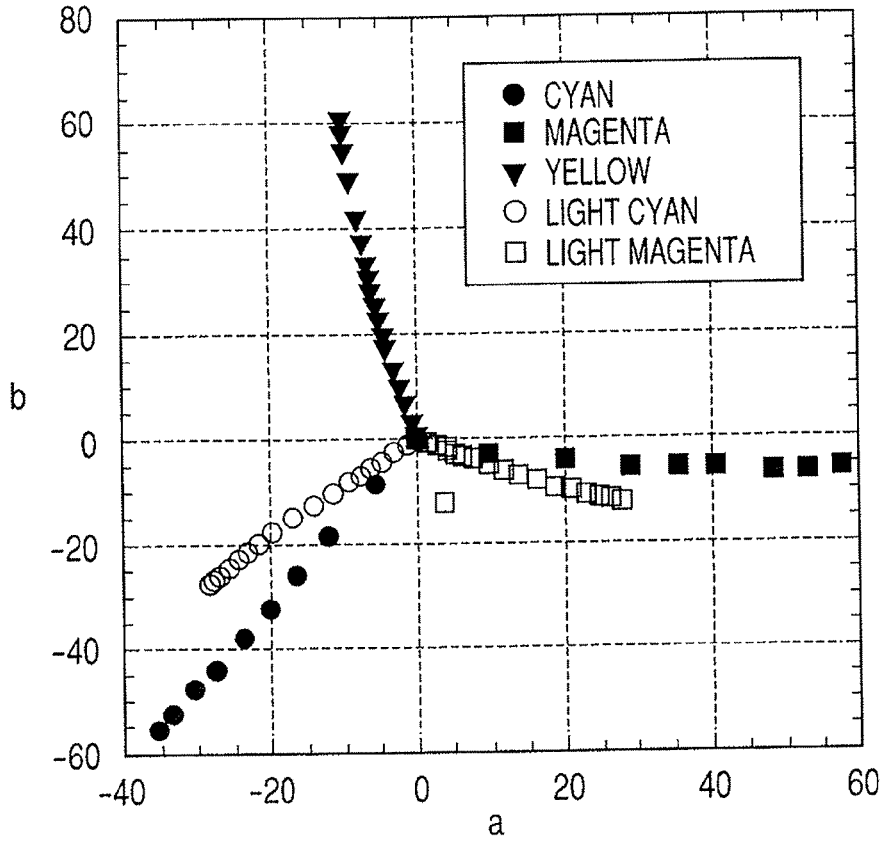
FIG. 3 illustrates the color characteristic of the toners of the present invention.

FIG. 3 shows the color characteristic when the obtained toner were actually outputted onto paper through an electrophotographic process, by the a*-b* plan view of CIELAB.

Figure 17:
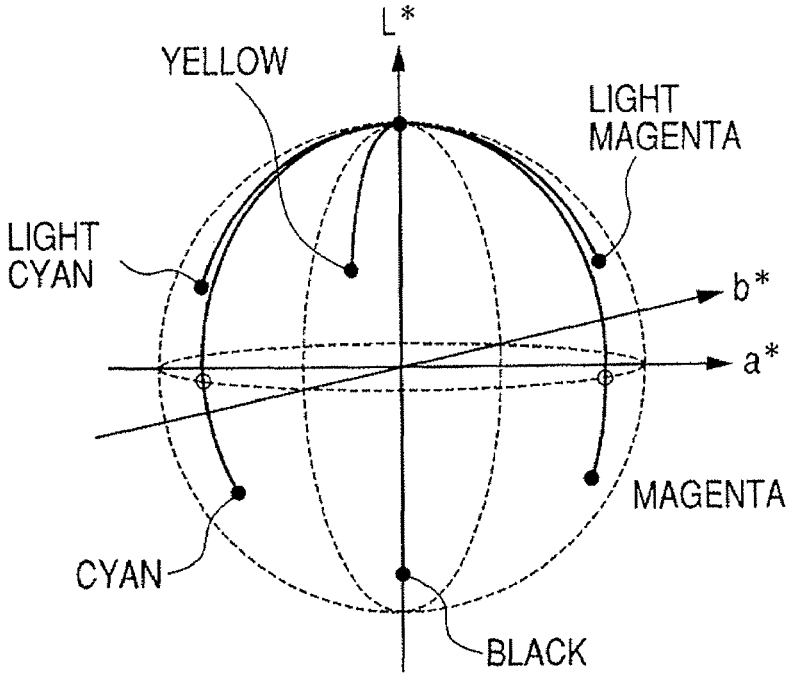
FIG. 17 illustrates CIE-LAB space and the gradation characteristics of toners used in the present invention in the space.
Figure 18:
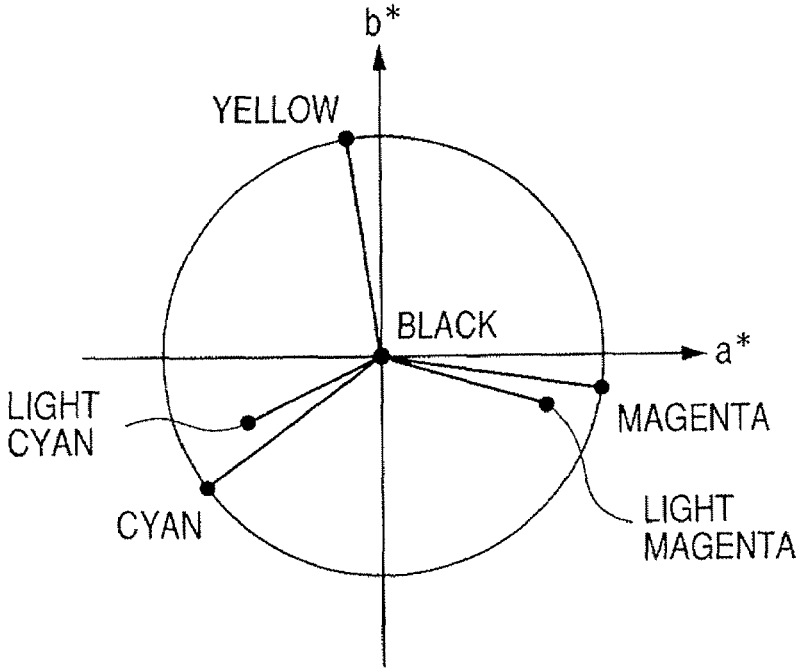
FIG. 18 illustrates the CIE-LAB space and the gradation characteristics of the toners used in the present invention in the space.

FIG. 17 shows an LAB space view of CIE-LAB, and FIG. 18 shows a projection view of the ab plane of the LAB space of CIE=LAB.

The CIE-LAB space will hereinafter be described with reference to FIGS. 17 and 18.

The color space represented by CIE-LAB is also called a uniform color space, and is provided with a characteristic coincident with the human visual impression. For example, in the projection view shown in FIG. 18, respective colors differing in the angle of hue from one another are perceived as different colors in conformity with the difference in angle by man. Speaking about the vertical axis brightness (L*) of FIG. 17, respective colors differing in the value of brightness form one another are perceived as different density in conformity with the difference in the value of brightness by man. From such a characteristic of the CIE-LAB space, the distance "$\sqrt{(L^2+a^2+b^2)}$" in the space is defined as a color difference ΔE, and is used in the evaluation or the like of color as the amount of difference between colors perceived by man.

For information, the tone characteristic of each color used in the present invention in the CIE-LAB space is schematically shown in FIGS. 17 and 18.

In these figures, there is shown a state in which the maximum value of L* is the brightest tone, and as the density becomes higher, L* lowers and is felt to be dark by man and at the same time, the chroma "$\sqrt{(a^2+b^2)}$" becomes greater, and reaches the maximum density at which the color taste is felt to be strong and yet, each color name is labelled.

Figure 4:
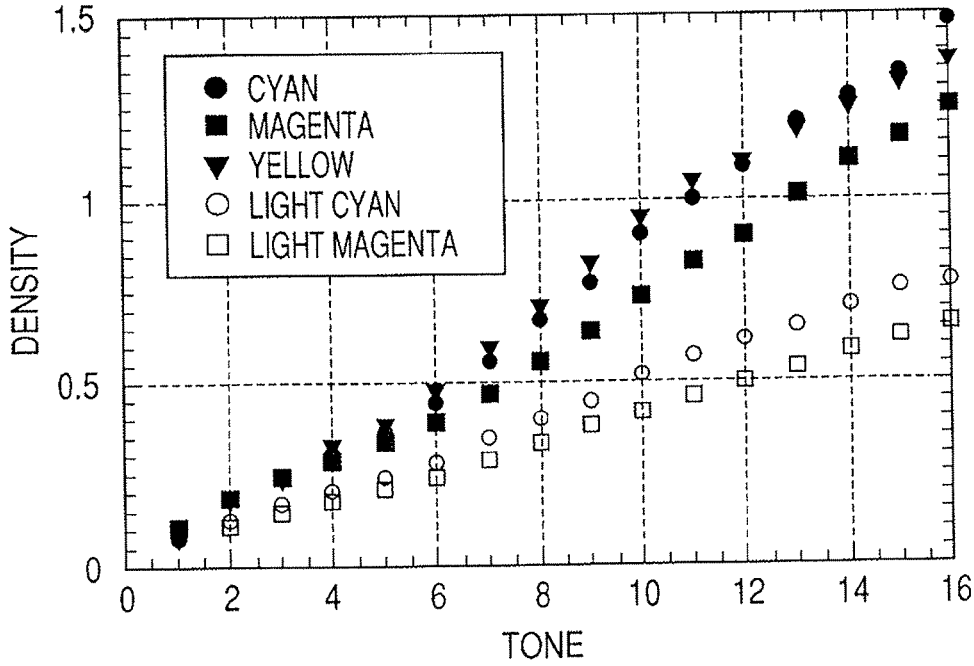
FIG. 4 illustrates the halftone characteristics of the toners of the present invention.

FIG. 4 shows the tone characteristics of the toners also when they were outputted onto paper.

Figure 7:
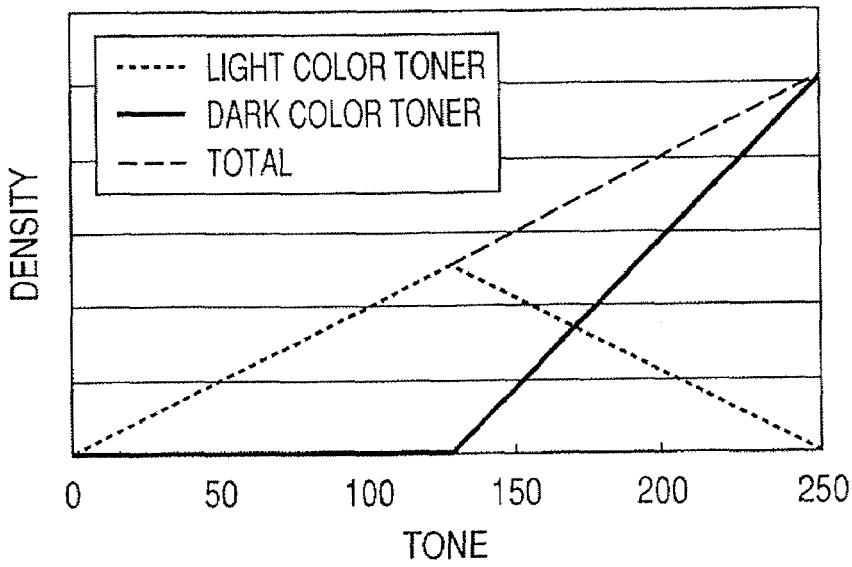
FIG. 7 illustrates the gradation characteristics of the toners of the present invention.

FIG. 7 shows the tone characteristics when the light and dark color toners were mixed together obtained by the tone setting of FIG. 2 with the axis of ordinates as density.

The "brightness value and density value" used in this specification were measured by the use of a spectral density meter MODEL: 528 produced by X-Rite Co., Inc.

In the present invention, it is a feature that on the basis of the above-described CIE-LAB space, a moiré component produced from screen patterns of plural colors is set so that the "color difference" perceived as a "different color" by man may become small, whereby a problem in an actual image is minimized.

A moiré pattern perceived by man is brought about by the color difference perceived by man between a location at which screen patterns of plural colors overlap one another and a location at which they do not overlap one another. In view of this characteristic, a combination of colors having a small color difference therebetween is set to a relatively near screen angle, whereby it becomes possible to sufficiently widen the combination angle of the other colors.

Also, as the reason for forming an image by a screen pattern having a plurality of angles, it is intended that the unevenness of density due to the difference in the superposition of colors do not occur even when misregistration or the like has occurred, and in the electrophotographic apparatus, the positional deviation in the image transporting direction is generally great, and it is necessary to make a screen design having sufficient tolerance against the positional deviation in the image transporting direction. Generally, it is known that as compared with a screen pattern perpendicular to the image transporting direction, a screen pattern having an angle approximate to the image transporting direction is higher in tolerance against the fluctuation of the position, and the present invention is also characterized in that the angle of such a screen pattern is optimized.

As the construction of the electrophotographic apparatus when outputting, it is possible to use various forms such as a six-series system shown in FIG. 5, a system provided with six developing apparatuses for one photosensitive member as shown in FIG. 6, and a system in which light color toners alone are added to an option. Herein, a six-color system is shown, but of course, other systems using a plurality of toner species are also usable.

EMBODIMENT 1

In this embodiment, use was made of a construction of "cyan, light cyan, magenta, light magenta, yellow and black (six colors in total)", and image outputting was effected by the use of six kinds of different screen patterns for the respective colors.

Figure 13:
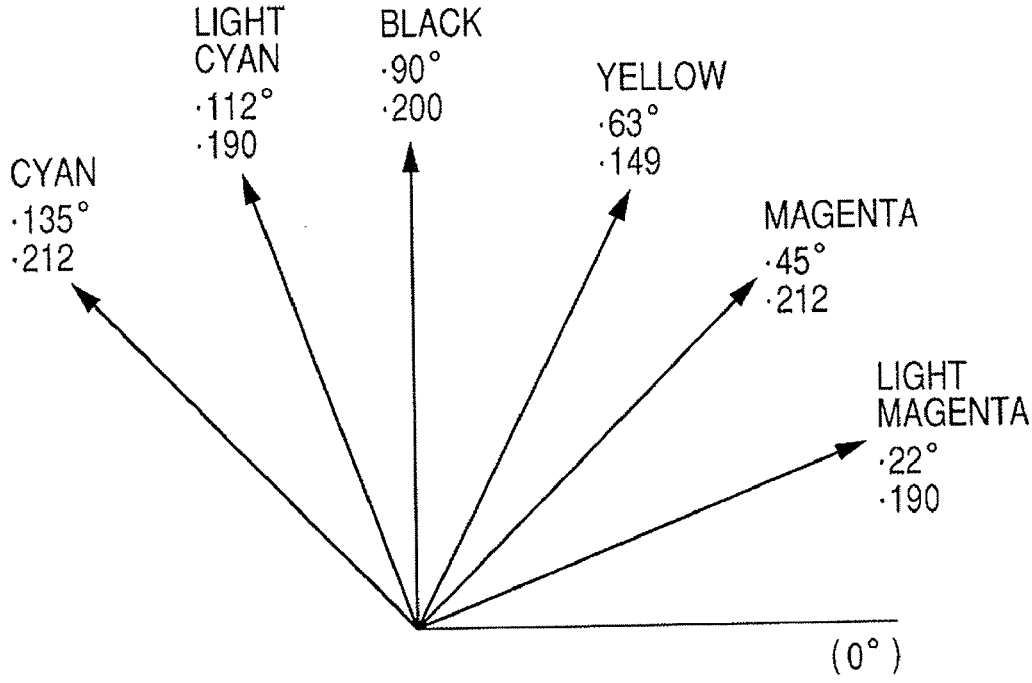
FIG. 13 shows screen angles in a first embodiment.

The resolution of the output was 600 dpi, and the then screen angles, as shown in FIG. 13, were set to yellow: 63°, cyan: 135°, light cyan: 112°, black: 90°, magenta: 45°, and light magenta: 22°.

As described above, different screen patterns are used for the respective colors, and screen angles are disposed so that combinations of the same hue and relatively small in color difference may be adjacent to one another. Thereby, a moiré pattern becomes difficult to see, and it becomes possible to sufficiently widen the combination angle of the other colors, and there is realized a good image output strong to the fluctuation of density due to the deviation of the printing position of each color.

EMBODIMENT 2

In this embodiment, use was made of a construction of "cyan, light cyan, magenta, light magenta, yellow and black (six colors in total), and image outputting was effected by the use of six kinds of different screen patterns for the respective colors.

Figure 14:
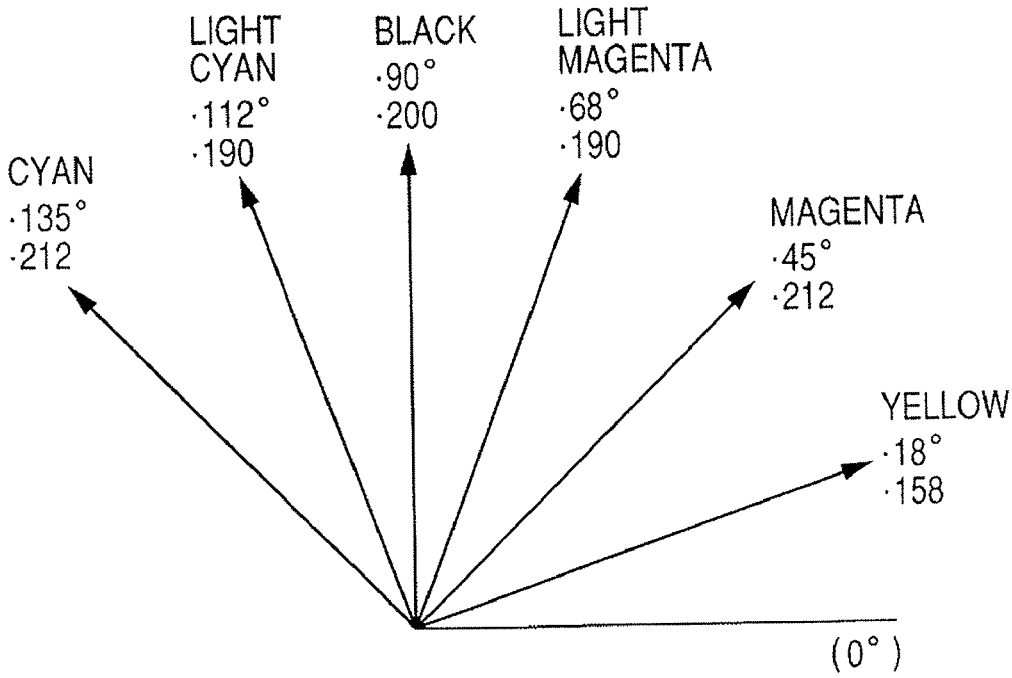
FIG. 14 shows screen angles in a second embodiment.

The resolution of the output was 600 dpi, and the then screen angles, as shown in FIG. 14, were set to yellow: 18°, cyan: 135°, light cyan: 112°, black: 90°, magenta: 45°, and light magenta: 68°.

As described above, cyan, magenta, yellow and black which are the basic hues of subtractive color mixture are uniformly disposed as by the conventional technique to thereby form a suitable Rosetta pattern, and when screen angles are to be disposed so that screen patterns used for two kinds of light and dark toner outputs of the same hue may be adjacent to each other at a relatively near angle, the screen angles are disposed at an angle near to the image transporting direction. Thereby, it becomes possible to minimize even the fluctuation of density due to the positional deviation between the respective colors in the image transporting direction which is liable to occur in the electrophotographic image recording apparatus, and there is realized a good image output.

EMBODIMENT 3

In this embodiment, use was made of a construction of "cyan, light cyan, magenta, light magenta, yellow and black (six colors in total)", and image outputting was effected by the use of six kinds of different screen patterns for the respective colors.

Figure 15:
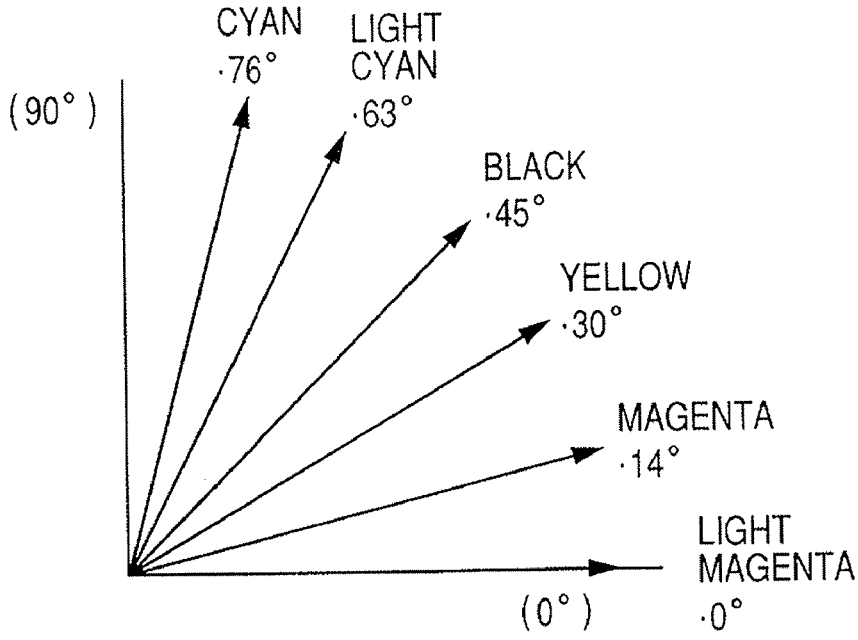
FIG. 15 shows screen angles in a third embodiment.

The resolution of the output was 1200 dpi, and the then screen angles, as shown in FIG. 15, were set to yellow: 30°, cyan: 76°, light cyan: 63°, black: 45°, magenta: 14°, and light magenta: 0°.

As described above, different screen patterns are used for the respective colors, and the screen angles are disposed at an angle whereat combinations of the same hue and relatively small in color difference are adjacent to each other. Thereby, a moiré pattern becomes difficult to see, and it becomes possible to sufficiently widen the combination angle of the other colors, and there is realized a good image output strong against even the fluctuation of density due to the deviation of the printing position of each color.

EMBODIMENT 4

In Embodiment 4, use was made of a construction of "cyan, light cyan, magenta, light magenta, yellow and black (six colors in total)", and image outputting was effected by the use of six kinds of different screen patterns for the respective colors.

Figure 16:
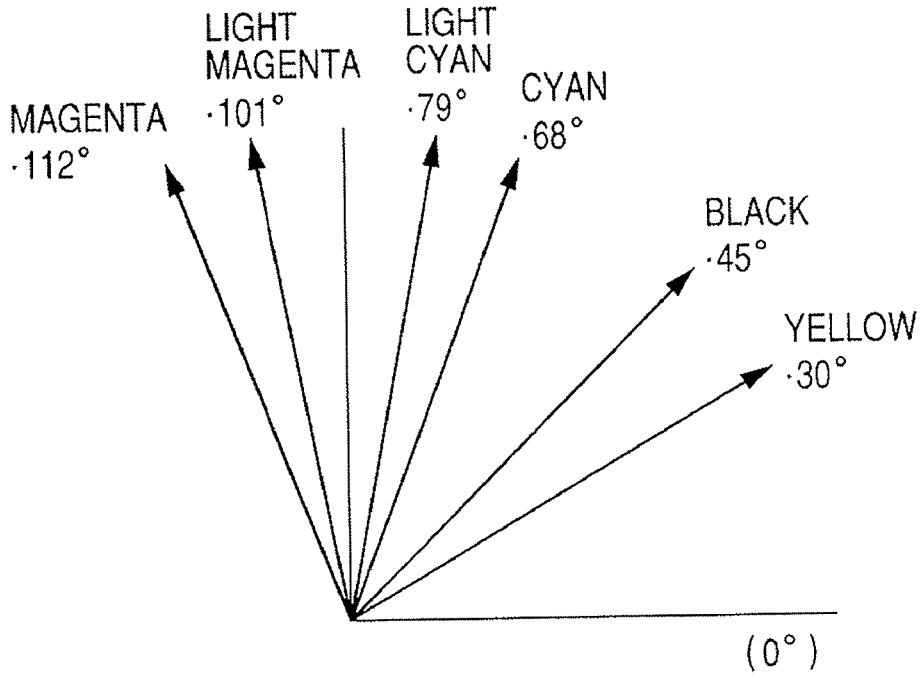
FIG. 16 shows screen angles in a fourth embodiment.

The resolution of the output was 1200 dpi, and the then screen angles, as shown in FIG. 16, were set to yellow: 30°, cyan: 68°, light cyan: 79°, black: 45°, magenta: 112°, and light magenta: 101°.

As described above, different screen patterns are used for the respective colors, and combinations of the same hue and relatively small in color difference are disposed at angles adjacent to each other, and further, screen angles are disposed adjacent to each other with yellow which is small in the change in its brightness component at an angle relatively approximate to that for the other colors. Thereby, a moiré pattern becomes difficult to see, and it becomes possible to sufficiently widen the combination angle of the other colors, and there is realized a good image output strong against even the fluctuation of density due to the deviation of the printing position of each color.

While in the foregoing embodiments, description has been made with the electrophotographic image recording apparatus taken as an example, the present invention is not restricted thereto, but is also applicable to various image recording apparatuses including an ink jet printer using ink as a colorant, instead of toners.

While the present invention has been described above with respect to some preferred embodiments thereof, the present invention is not restricted to these embodiments, but it is apparent that various modifications and applications are possible within the scope of the appended claims.

This application claims priority from Japanese Patent Application No. 2004-259755 filed Sep. 7, 2004, which is hereby incorporated by reference herein.

The invention claimed is:

1. An electrophotographic color image recording apparatus including:

an image bearing member having photoconductivity;

a charging unit adapted to charge said image bearing member;

an exposure unit adapted to expose the surface of the image bearing member after charging to form an electrostatic latent image;

a developing unit adapted to cause one of plural kinds of toners to adhere to said electrostatic latent image to form a toner image;

a transferring unit adapted to superimpose and transfer plural kinds of toner images obtained by said developing unit; and a processing unit adapted to execute tone-process to image data to be sent to said exposure unit;

wherein said plural kinds of toners include at least toner of dark color and toner of light color, each said toner having substantially the same hue and different densities from each other, and wherein said processing unit executes the tone-process by the use of a screen pattern having different screen angles for the respective toner of dark color and the toner of light color;

wherein the tone-process is executed to dispose a screen angle so as to adjoin the screen angles of one or more toner sets of the light color and the dark color and to widen a difference between the screen angles of other toner sets of colors different from the one or more toner sets of the light color and the dark color having substantially the same hue and different densities from each other to be greater than the difference between the screen angles of the one or more toner sets of the light color and the dark color.

2. An electrophotographic image recording apparatus according to claim 1, wherein two kinds of light color and dark color toners are used for at least cyan and magenta, and the screen angles of the screen patterns of the light color toners and the dark color toners are line-symmetrically disposed with an image transporting direction as an axis.

3. An image processing apparatus for a color image forming apparatus which forms a color image by the use of plural kinds of colorants, including:

a processing unit adapted to execute halftone processing image data to be sent to said image forming apparatus;

wherein said plural kinds of colorants include two kinds of colorants of substantially the same hue and differing in density from each other, and wherein said processing unit executes tone-process by the use of a screen pattern having different screen angles for the respective colorants, wherein the tone-process is executed to dispose a screen angle so as to adjoin the screen angles of one or more colorant sets of the light color and the dark color and to widen a difference between the screen angles of other colorant sets of colors different from the one or more colorant sets of light color and dark color having substantially the same hue and different densities from each other to be greater than the difference between the screen angles of the one or more colorant sets of light color and dark color.

4. An image processing apparatus according to claim 3, wherein the two kinds of colorants of light color and dark color are at least in cyan and magenta colorants of substantially the same hue and different densities, and the screen angles of the screen patterns of the colorants of lighter color and colorants of dark color are line-symmetrically disposed with an image transporting direction as an axis.

5. An electrophotographic color image recording apparatus including:

an image bearing member having photoconductivity;

a charging unit adapted to charge said image bearing member;

an exposure unit adapted to expose the surface of the image bearing member after charged to thereby form an electrostatic latent image;

a developing unit adapted to cause plural kinds of toners to adhere to said electrostatic latent image to thereby form a toner image;

a transferring unit adapted to superimpose and transfer plural kinds of toner images obtained by said developing unit; and a processing unit adapted to tone-process image data to be sent to said exposure unit;

wherein said plural kinds of toners include a toner set of cyan and light cyan or a toner set of magenta and light magenta, wherein said processing unit executes the tone-process by the use of a screen pattern having different screen angles of the respective colors, wherein the tone-process is executed to dispose the screen angle so as to adjoin the screen angles of a toner set of cyan and light cyan or adjoin the screen angles of a toner set of magenta and light magenta with each other, and to widen a difference between the screen angles of other toner sets of colors to be greater than the difference between the screen angles of the toner sets of cyan and light cyan and of magenta and light magenta.

* * * * *